US012559825B2

(12) United States Patent
Duan et al.

(10) Patent No.: US 12,559,825 B2
(45) Date of Patent: Feb. 24, 2026

(54) 690 MPa-GRADE MEDIUM MANGANESE STEEL MEDIUM THICK STEEL WITH HIGH STRENGTH AND LOW YIELD RATIO AND MANUFACTURING METHOD THEREFOR

(71) Applicant: NANJING IRON & STEEL CO., LTD., Nanjing (CN)

(72) Inventors: DongMing Duan, Nanjing (CN); Chao Sun, Nanjing (CN); YanTang Chen, Nanjing (CN); YuWe Zhou, Nanjing (CN); CongDao Wang, Nanjing (CN); Ming Li, Nanjing (CN)

(73) Assignee: NANJING IRON & STEEL CO., LTD., Nanjing (CN)

( * ) Notice: Subject to any disclaimer, the term of this patent is extended or adjusted under 35 U.S.C. 154(b) by 641 days.

(21) Appl. No.: 17/756,192

(22) PCT Filed: Mar. 23, 2020

(86) PCT No.: PCT/CN2020/097643
§ 371 (c)(1),
(2) Date: May 19, 2022

(87) PCT Pub. No.: WO2021/098208
PCT Pub. Date: May 27, 2021

(65) Prior Publication Data

US 2022/0411907 A1 Dec. 29, 2022

(30) Foreign Application Priority Data

Nov. 20, 2019 (CN) ..... 201911138357.5

(51) Int. Cl.

| | |
|---|---|
| ***C22C 38/04*** | (2006.01) |
| ***C21C 7/064*** | (2006.01) |
| ***C21D 6/00*** | (2006.01) |
| ***C21D 8/02*** | (2006.01) |
| ***C21D 8/0247*** | (2026.01) |
| ***C22C 33/04*** | (2006.01) |
| ***C22C 38/02*** | (2006.01) |
| ***C22C 38/44*** | (2006.01) |
| ***C22C 38/50*** | (2006.01) |

(52) U.S. Cl.
CPC ..... *C22C 38/04* (2013.01); *C21C 7/064* (2013.01); *C21D 6/004* (2013.01); *C21D 8/0205* (2013.01); *C21D 8/0273* (2013.01); *C22C 33/04* (2013.01); *C22C 38/02* (2013.01); *C22C 38/44* (2013.01); *C22C 38/50* (2013.01)

(58) Field of Classification Search
CPC ..... C22C 38/04; C22C 33/04; C22C 38/50; C22C 38/38; C22C 38/58; C21C 7/064; C21D 8/0226; C21D 8/0247
See application file for complete search history.

(56) References Cited

U.S. PATENT DOCUMENTS

2020/0087764 A1* 3/2020 Sano ..... C22C 38/58

FOREIGN PATENT DOCUMENTS

| | | | | |
|---|---|---|---|---|
| CN | 103556048 A | * | 2/2014 | |
| CN | 105755371 A | * | 7/2016 | ..... C21D 8/0226 |
| CN | 108385037 A | * | 8/2018 | ..... C21D 8/0226 |

* cited by examiner

*Primary Examiner* — Jonathan Johnson
(74) *Attorney, Agent, or Firm* — PROI Intellectual Property US

(57) ABSTRACT

A manganese steel consisting essentially of the following chemical composition in mass percentages: C: 0.05%-0.10%, Mn: 4.1%-4.7%, Si: 0.15%-0.4%, P≤0.010%, S≤0.003%, Ti: 0.01%-0.05%, Ni+Cr+Mo≤0.6%, and the balance of Fe and unavoidable impurities, the steel having a tensile strength between about 785 MPa to about 856 MPa.

5 Claims, 1 Drawing Sheet

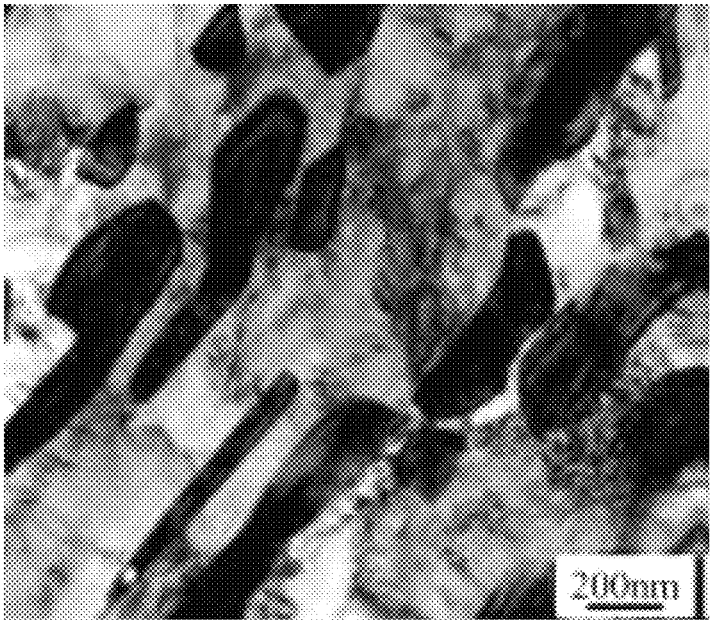
200nm

690 MPa-GRADE MEDIUM MANGANESE STEEL MEDIUM THICK STEEL WITH HIGH STRENGTH AND LOW YIELD RATIO AND MANUFACTURING METHOD THEREFOR

TECHNICAL FIELD

The present disclosure relates to the technical field of steel smelting, and specifically relates to a 690 MPa high-strength medium-manganese steel with low yield ratio and medium thickness and a manufacture method thereof.

BACKGROUND

The 690 MPa high-strength steel for the construction machinery is widely used in the important fields of the national economy such as construction machinery, coal mine hydraulic supports, military boats and bridges, crane booms and the like. Ni, Cr, and Mo with high contents added into the composition system of the 690 MPa high-strength steel causes high cost. What's more, the thick products have poor hardenability, uneven structure in the thickness direction, low toughness of the steel core, and excessively high yield ratio (generally reaching above 0.94). And the excessively high yield ratio would lead to local large deformation to cause instability due to overload.

SUMMARY

To solve the above technical problems, the present disclosure provides a 690 MPa high-strength medium-manganese steel with low yield ratio and medium thickness, which is composed of the following chemical composition in mass percentage: C: 0.05%-0.10%, Mn: 4.1%-4.7%, Si: 0.15%-0.4%, P≤0.010%, S≤0.003%, Ti: 0.01%-0.05%, Ni+Cr+Mo≤0.6%, and the balance of Fe and unavoidable impurities.

The technical effects are as follows: the present disclosure adds medium manganese to reduce the content of alloying elements such as Ni and Cr in the steel. Alloying the medium manganese is capable of effectively controlling the microstructure of the high-strength steel, and significantly reducing the yield ratio and cost of the steel. The content, size and distribution of retained austenite in the steel is precisely controlled through the reasonable composition design and microstructure properties control, so that the crack arrest performance of the steel is effectively improved. The steel plate manufactured has excellent comprehensive properties, capable of solving the problems of poor low-temperature toughness and excessively high yield ratio of various high-strength structural steels for the construction machinery, and meeting the safety performance and construction cost requirements on the ultra-high-strength steel in complex environments.

The technical solution further limited by the present disclosure is as follows:

A thickness of a steel plate manufactured by the 690 MPa high-strength medium-manganese steel with low yield ratio and medium thickness is less than 80 mm, and a yield ratio of the steel plate is less than 0.86.

The 690 MPa high-strength medium-manganese steel with low yield ratio and medium thickness is composed of the following chemical composition in mass percentage: C: 0.09%-0.10%, Mn: 4.65%-4.7%, Si: 0.18%-0.22%, P≤0.010%, S≤0.003%, Ti: 0.022%-0.028%, Ni+Cr+Mo≤0.6%, and the balance of Fe and unavoidable impurities.

The 690 MPa high-strength medium-manganese steel with low yield ratio and medium thickness is composed of the following chemical composition in mass percentage: C: 0.05%-0.06%, Mn: 4.23%-4.47%, Si: 0.20%-0.26%, P≤0.010%, S≤0.003%, Ti: 0.018%-0.026%, Ni+Cr+Mo≤0.6%, and the balance of Fe and unavoidable impurities.

The 690 MPa high-strength medium-manganese steel with low yield ratio and medium thickness is composed of the following chemical composition in mass percentage: C: 0.05%-0.07%, Mn: 4.1%-4.28%, Si: 0.15%-0.21%, P≤0.010%, S≤0.003%, Ti: 0.033%-0.045%, Ni+Cr+Mo≤0.6%, and the balance of Fe and unavoidable impurities.

Another object of the present disclosure is providing a method for manufacturing the 690 MPa high-strength medium-manganese steel with low yield ratio and medium thickness, comprising:

- molten iron desulfurization treatment and converter smelting: reducing contents of P and S in a molten steel to be ≤0.010% and 0.003%, respectively;
- ladle furnace (LF) refining: alloying C, Mn, Si, Ti, Ni, Cr, and Mo in a required mass fraction;
- slab casting: a casting speed for a continuous casting slab being ≤1.0 m/min, and cleaning up surface defects;
- slab heating control: a temperature being 1060-1140° C., and a soaking time being 40-90 min;
- slab rolling control: performing a two-stage rolling process, wherein, an initial rolling temperature and a final rolling temperature in a first stage are ≤1020° C. and >920° C., respectively, and the initial rolling temperature and the final rolling temperature in a second stage are ≤890° C. and >800° C., respectively;
- post-rolling cooling: a cooling rate being ≥5° C./s, and a self-tempering temperature of surface of the steel plate after cooling being ≤350° C.; and
- post-rolling heat treatment: putting into a heat treatment furnace for tempering within 48 hours after rolling; wherein, a tempering temperature is 600-650° C., and the soaking time is 40-70 min; the steel plate is air-cooled to room temperature after tempering.

The beneficial effects of the present disclosure are as follows:

(1) In the present disclosure, C is an important strengthening element and an important austenite stabilizing element, capable of significantly improving the microstructure strength through interstitial solid solution strengthening. However, the addition amount of C is required to be controlled at a lower level to ensure low-temperature impact toughness and weldability.

Mn is capable of improving the microstructure strength through substitutional solid solution strengthening, and significantly enhancing the stability of austenite. Increasing the content of Mn is capable of improving the hardenability of the steel plate, so that the steel plate forms martensite in a wide range of cooling rate, and then forms part of reversed austenite in the two-phase region annealing process. The tempered martensite increases the strength of the steel plate, and the reversed austenite improves the toughness and plasticity of the steel plate.

Si is a deoxidizing element in the steelmaking process. An appropriate amount of Si added is capable of inhibiting the segregation of Mn and P and the formation of cementite, and improving the toughness. However, the excessively high content of Si would significantly reduce the toughness. Therefore, the content of Si in the present disclosure is controlled to be 0.15%-0.4%.

The contents of P and S are strictly controlled. The medium content of Mn added in the present disclosure makes S easy to form MnS with Mn to reduce the plasticity. P is prone to segregate at the grain boundary to reduce the crack growth resistance of the grain boundary. Thus, the toughness is reduced. The contents of P and S in the present disclosure are controlled to be ≤0.010% and 0.003%, respectively.

Ti is capable of hindering the grain boundary migration at high temperature through the precipitation of the fine and dispersed second phase, to refine the grains and improve the mechanical properties. The addition amount of Ti is controlled to be 0.01%-0.05%.

An appropriate amount of Ni added is capable of stabilizing the austenite phase, improving the hardenability, and reducing the ductile-brittle transition temperature to improve the weldability. The significant solid solution strengthening effect generated by Cr improves the strength. Mo is capable of improving the strength of tempered martensite, and reducing the grain boundary segregation of Mn within a certain content range to improve the toughness. The content of Ni+Cr+Mo in the present disclosure is controlled to be within 0.6%, so that their effects are exerted without significantly increasing the cost.

(2) The thickness of the steel plate manufactured by the present disclosure is less than 80 mm, and the comprehensive mechanical properties of the steel plate meet the technical requirements of Q690M steel in GB/T1591-2018 low-alloy high-strength structural steels. At the same time, the yield ratio of the steel plate is not more than 0.86.

(3) The present disclosure adopts tempered martensite+reversed austenite to form the microstructure of the steel plate. The tempered martensite ensures the strength of the steel plate, and the reversed austenite improves the plasticity and toughness of the steel plate. Due to the good hardenability of the high-strength steel designed with this composition, tempered martensite+reversed austenite are formed in the whole thickness direction.

(4) In the chemical composition of the present disclosure, manganese is the main alloying element, and no or less precious alloying elements are added. Thus, the cost per ton of steel is reduced more than 1,000 yuan than that of the traditional high-strength structural steel of the same level. The present disclosure saves a huge cost.

(5) The core of the steel plate of the present disclosure has excellent mechanical properties. Thus, the steel plate meets the safety performance and construction cost requirements of the construction machinery on the ultra-high-strength steel in the complex environments.

BRIEF DESCRIPTION OF THE DRAWINGS

FIG. 1 is a metallographic structure diagram of a steel plate after performing heat treatment in Example 1 of the present disclosure.

DETAILED DESCRIPTION OF THE EMBODIMENTS

Example 1

This example provides the 690 MPa high-strength medium-manganese steel with low yield ratio and the thickness of 70 mm, including the following chemical composition in mass percentage: C: 0.09%, Mn: 4.65%, Si: 0.22%, P: 0.008%, S: 0.001%, Ti: 0.028%, Ni+Cr+Mo: 0.58%, and the balance of Fe and unavoidable impurities.

The method for manufacturing the steel plate is as follows:

Converter smelting is carried out after the molten iron desulfurization treatment is performed, so that the contents of S and P in the molten steel are reduced. C, Mn, Si, Ti, Ni, Cr, and Mo in the required mass fraction are alloyed after the ladle furnace (LF) refining is completed. The continuous casting method is adopted with the casting speed of the continuous casting slab being 0.5 m/min, and the surface defects are cleaned up, to obtain the slab with the thickness of 320 mm. The obtained slab is heated to 1130° C. with the soaking time of 70 min. The heated slab is performed with the two-stage rolling process. The initial rolling temperature and the final rolling temperature in the first stage are 1010° C. and 965° C., respectively. The initial rolling temperature and the final rolling temperature in the second stage are 885° C. and 832° C., respectively. The rolled steel plate is water-cooled with the cooling rate of 6.1° C./s, and the self-tempering temperature of the surface of the steel plate after cooling is lower than 200° C. Tempering as the heat treatment is carried out immediately after rolling, with the tempering temperature of 640° C. and the soaking time of 82 min. The steel plate is air-cooled to room temperature after tempering.

Example 2

This example provides the 690 MPa high-strength medium-manganese steel with low yield ratio and the thickness of 50 mm, including the following chemical composition in mass percentage: C: 0.06%, Mn: 4.47%, Si: 0.26%, P: 0.009%, S: 0.001%, Ti: 0.026%, Ni+Cr+Mo: 0.46%, and the balance of Fe and unavoidable impurities.

The method for manufacturing the steel plate is as follows:

Converter smelting is carried out after the molten iron desulfurization treatment is performed, so that the contents of S and P in the molten steel are reduced. C, Mn, Si, Ti, Ni, Cr, and Mo in the required mass fraction are alloyed after the LF refining is completed. The continuous casting method is adopted with the casting speed of the continuous casting slab being 0.6 m/min, and the surface defects are cleaned up, to obtain the slab with the thickness of 320 mm. The obtained slab is heated to 1130° C. with the soaking time of 70 min. The heated slab is performed with the two-stage rolling process. The initial rolling temperature and the final rolling temperature in the first stage are 1005° C. and 945° C., respectively. The initial rolling temperature and the final rolling temperature in the second stage are 865° C. and 823° C., respectively. The rolled steel plate is water-cooled with the cooling rate of 7.3° C./s, and the self-tempering temperature of the surface of the steel plate after cooling is lower than 200° C. Tempering as the heat treatment is carried out immediately after rolling, with the tempering temperature of 630° C. and the soaking time of 71 min. The steel plate is air-cooled to room temperature after tempering.

Example 3

This example provides the 690 MPa high-strength medium-manganese steel with low yield ratio and with the thickness of 30 mm, including the following chemical composition in mass percentage: C: 0.05%, Mn: 4.28%, Si:

0.21%, P: 0.008%, S: 0.001%, Ti: 0.033%, Ni+Cr+Mo: 0.39%, and the balance of Fe and unavoidable impurities.

The method for manufacturing the steel plate is as follows:

Converter smelting is carried out after the molten iron desulfurization treatment is performed, so that the contents of S and P in the molten steel are reduced. C, Mn, Si, Ti, Ni, Cr, and Mo in the required mass fraction are alloyed after the LF refining is completed. The continuous casting method is adopted with the casting speed of the continuous casting slab being 0.6 m/min, and the surface defects are cleaned up, to obtain the slab with the thickness of 260 mm. The obtained slab is heated to 1110° C. with the soaking time of 59 min. The heated slab is performed with the two-stage rolling process. The initial rolling temperature and the final rolling temperature in the first stage are 1005° C. and 935° C., respectively. The initial rolling temperature and the final rolling temperature in the second stage are 870° C. and 812° C., respectively. The rolled steel plate is water-cooled with the cooling rate of 12.1° C./s, and the self-tempering temperature of the surface of the steel plate after cooling is lower than 200° C. Tempering as the heat treatment is carried out immediately after rolling, with the tempering temperature of 610° C. and the soaking time of 55 min. The steel plate is air-cooled to room temperature after tempering.

The comprehensive mechanical properties of the steel plates manufactured in Examples 1-3 are shown in Table 1.

TABLE 1

Comprehensive mechanical properties of the steel plates manufactured in Examples 1-3

| | | | Properties result | | | | | | |
|---|---|---|---|---|---|---|---|---|---|
| | Thickness/ | Sampling | Yield strength/ | Tensile strength/ | Yield | Elongation/ | Bend test | Charpy impact energy/J | |
| Examples | mm | site | MPa | MPa | ratio | % | d = 3a | −40° C. | −60° C. |
| Example 1 | 70 | ¼t | 681 | 806 | 0.845 | 23 | intact | 248 | 185 |
| | | | | | | | | 265 | 195 |
| | | | | | | | | 227 | 177 |
| | | ½t | 660 | 785 | 0.841 | 24 | intact | 198 | 148 |
| | | | | | | | | 202 | 169 |
| | | | | | | | | 185 | 152 |
| Example 2 | 50 | ¼t | 723 | 846 | 0.855 | 21 | intact | 295 | 196 |
| | | | | | | | | 288 | 172 |
| | | | | | | | | 282 | 189 |
| | | ½t | 703 | 829 | 0.848 | 23 | intact | 201 | 165 |
| | | | | | | | | 195 | 155 |
| | | | | | | | | 210 | 171 |
| Example 3 | 30 | ¼t | 742 | 865 | 0.857 | 20 | intact | 276 | 199 |
| | | | | | | | | 281 | 187 |
| | | | | | | | | 266 | 192 |
| | | ½t | 722 | 843 | 0.856 | 22 | intact | 286 | 221 |
| | | | | | | | | 267 | 211 |
| | | | | | | | | 277 | 231 |

TABLE 2

Comprehensive mechanical properties of Q690M steel with 690MPa level in GB/T 1591-2018 standard

| Nominal thickness/ mm | Yield strength (no less than)/MPa | Tensile strength/ MPa | Elongation no less than/% | Minimum Charpy impact energy/J | Bend test |
|---|---|---|---|---|---|
| ≤16 | 690 | 770-940 | 14 | 0° C.: transverse 55, longitudinal 34 | D = 2a |
| >16-40 | 680 | | | −20° C.: transverse 47, longitudinal 27 | D = 3a |
| >40-63 | 670 | 750-920 | | −40° C.: transverse 31, longitudinal 20 | |
| >63-80 | 650 | 730-900 | | | |

Table 2 shows the comprehensive mechanical properties requirements of the Q690M steel with 690 MPa level in the GB/T 1591-2018 standard. It can be seen from FIG. 1 that the present disclosure uses manganese as the main alloying element to replace the precious Ni—Mo alloy. The hardenability of the steel plate is improved through the Mn element, so that the steel plate forms martensite in a wide range of cooling rate, and then forms part of reversed austenite in the two-phase region annealing process. The tempered martensite increases the strength of the steel plate, and the reversed austenite improves the toughness and plasticity of the steel plate. Thus, the steel plate manufactured has high strength, low yield ratio, and excellent mechanical properties of the steel core, which meets the safety performance and construction cost requirements of the construction machinery on the ultra-high-strength steel in the complex environments.

In addition to the above-mentioned examples, the present disclosure may also have other examples. All technical solutions formed by equivalent replacements or transformations shall fall within the protection scope of the present disclosure.

What is claimed is:

1. A manganese steel obtained by a method comprising:

molten iron desulfurization treatment and converter smelting: reducing contents of P and S to be ≤0.010% and 0.003% in a molten steel, respectively;

ladle furnace (LF) refining: alloying C, Mn, Si, Ti, Ni, Cr, and Mo in a required mass fraction;

slab casting: a casting speed for a continuous casting slab being ≤1.0 m/min, and cleaning up surface defects;

slab heating control: a temperature being 1060-1140° C. and a soaking time being 40-90 min;

slab rolling control: performing a two-stage rolling process, wherein, an initial rolling temperature and a final rolling temperature in a first stage are ≤1020° C. and ≥920° C. respectively; and the initial rolling temperature and the final rolling temperature in a second stage are ≤890° C. and ≥800° C., respectively;

post-rolling cooling control: a cooling rate being ≥5° C./s, and a self-tempering temperature of a surface of the steel plate after cooling being ≤350° C.; and post-rolling heat treatment: putting the steel plate into a heat treatment furnace for tempering within 48 hours after rolling: wherein, a tempering temperature is 600-650° C. and the soaking time is 40-70 min: the steel plate is air-cooled to room temperature after tempering;

wherein, said steel product consists essentially of the following chemical composition in mass percentages: C: 0.05%-0.10%, Mn: 4.1%-4.7%, Si: 0.15%-0.4%, P≤0.010%, S≤0.003%, Ti: 0.01%-0.05%, Ni+Cr+Mo≤0.6%, and the balance of Fe and unavoidable impurities, said steel having a tensile strength between 785 MPa to 865 MPa and a Charpy impact energy of 148 J-231 J at −60° C.

2. The manganese steel of claim 1, the manganese steel consisting essentially of the following chemical composition in mass percentages: C: 0.09%-0.10%, Mn: 4.65%-4.7%, Si: 0.18%-0.22%, P≤0.010%, S≤0.003%, Ti: 0.022%-0.028%, Ni+Cr+Mo≤0.6%, and the balance of Fe and unavoidable impurities.

3. The manganese steel of claim 1, the manganese steel consisting essentially of the following chemical composition in mass percentages: C: 0.05%-0.06%, Mn: 4.23%-4.47%, Si: 0.20%-0.26%, P≤0.010%, S≤0.003%, Ti: 0.018%-0.026%, Ni+Cr+Mo≤0.6%, and the balance of Fe and unavoidable impurities.

4. The manganese steel of claim 1, the manganese steel consisting essentially of the following chemical composition in mass percentages: C: 0.05%-0.07%, Mn: 4.1%-4.28%, Si: 0.15%-0.21%, P≤0.010%, S≤0.003%, Ti: 0.033%-0.045%, Ni+Cr+Mo≤0.6%, and the balance of Fe and unavoidable impurities.

5. A steel plate comprising the manganese steel of claim 1, wherein a thickness of the steel plate being between 530 mm to 80 mm, and a yield ratio of the steel plate being between 0.841 to 0.857.

* * * * *